US011122845B2

(12) United States Patent
Berisford et al.

(10) Patent No.: US 11,122,845 B2
(45) Date of Patent: Sep. 21, 2021

(54) INTERACTIVE SWEATBAND DEVICE

(71) Applicants: Kimberley Berisford, Raleigh, NC (US); Micajah L. Jones, Raleigh, NC (US)

(72) Inventors: Kimberley Berisford, Raleigh, NC (US); Micajah L. Jones, Raleigh, NC (US)

( * ) Notice: Subject to any disclaimer, the term of this patent is extended or adjusted under 35 U.S.C. 154(b) by 231 days.

(21) Appl. No.: 15/790,188

(22) Filed: Oct. 23, 2017

(65) Prior Publication Data

US 2019/0116897 A1 Apr. 25, 2019

(51) Int. Cl.

| | |
|---|---|
| ***A41D 20/00*** | (2006.01) |
| ***A42C 5/02*** | (2006.01) |
| ***A42B 7/00*** | (2006.01) |
| ***A41D 27/08*** | (2006.01) |
| *A42B 3/10* | (2006.01) |
| *A42B 1/06* | (2021.01) |
| *A41D 13/11* | (2006.01) |
| *A42B 3/04* | (2006.01) |
| *A42C 5/04* | (2006.01) |

(52) U.S. Cl.

CPC ..... *A41D 20/00* (2013.01); *A41D 27/08* (2013.01); *A42B 7/00* (2013.01); *A42C 5/02* (2013.01); *A41D 13/1184* (2013.01); *A41D 20/005* (2013.01); *A42B 1/069* (2013.01); *A42B 3/0406* (2013.01); *A42B 3/10* (2013.01); *A42C 5/04* (2013.01)

(58) Field of Classification Search

CPC ..... A41D 20/00; A41D 20/005; A41D 27/08; A41D 13/1184; A42B 7/00; A42B 1/069; A42B 3/0406; A42B 3/10; A42C 5/02; A42C 5/04

USPC ..... 2/181, 181.4, 181.6, 181.8

See application file for complete search history.

(56) References Cited

U.S. PATENT DOCUMENTS

| | | | | | |
|---|---|---|---|---|---|
| 386,634 | A * | 7/1888 | Greene | A42C 5/02 | 2/181 |
| 773,349 | A * | 10/1904 | Strouse | A42C 5/04 | 2/182.7 |
| 2,320,782 | A * | 6/1943 | Larsen | A41D 20/00 | 2/171 |
| 2,783,474 | A * | 3/1957 | Campagna | A41D 20/00 | 2/171 |
| 3,466,664 | A * | 9/1969 | Militello | A41D 20/005 | 2/171 |
| 4,910,804 | A * | 3/1990 | Lidgren | A41D 20/00 | 2/181.8 |
| 5,025,504 | A * | 6/1991 | Benston | A42B 3/10 | 2/181.4 |

(Continued)

*Primary Examiner* — Khaled Annis
*Assistant Examiner* — Dakota Marin
(74) *Attorney, Agent, or Firm* — Forrest Firm, P.C.

(57) ABSTRACT

An interactive sweatband includes a center portion having a first end and an opposing second end. The sweatband includes a first wing portion that extends from and is operably engaged with the first end of the center portion. The sweatband includes a second wing portion that extends from and is operably engaged with the opposing second end of the center portion. The sweatband device may further include a front surface and an opposing rear surface. The sweatband may include an outflow channel that extends along and is defined by at least one of the front and opposing rear surface of the sweatband.

8 Claims, 6 Drawing Sheets

(56) References Cited

U.S. PATENT DOCUMENTS

| | | | | | |
|---|---|---|---|---|---|
| 5,033,122 | A * | 7/1991 | Smith | A41D 20/00 | 2/170 |
| 5,822,798 | A * | 10/1998 | Baxley | A45D 8/34 | 2/182.6 |
| 6,108,818 | A * | 8/2000 | Eisenberg | A41D 20/00 | 2/181.2 |
| 7,681,252 | B1 * | 3/2010 | Petry | A42C 5/02 | 2/174 |
| 8,850,617 | B2 * | 10/2014 | Higgins | A42C 5/02 | 2/181 |
| 2007/0199132 | A1 * | 8/2007 | Lehmann | A42B 1/22 | 2/181 |
| 2016/0286888 | A1 * | 10/2016 | Abraham | A42B 3/125 | |

* cited by examiner

INTERACTIVE SWEATBAND DEVICE

BACKGROUND

Field of the Disclosure

The present disclosure relates generally to a sweatband device, and more particularly, to an interactive sweatband device configured to adhere to a person's skin, such as a user's forehead, and retain perspiration without circumscribing the user's head.

Description of Related Art

Strenuous activity, such as aerobic exercises, generally causes a person to perspire extensively. In particular, a person's head and scalp generates a significant amount of perspiration that may condense into droplets of perspiration that generally travel down the person's face and/or into a person's eyes. Sweatbands known in the art generally include a thick absorbent material, such as terry cloth, that completely circumscribe a user's head, wrist, and/or other body part. Such known sweatbands are generally cumbersome and may not be suitable for use with protective headgear, such as cycling helmets, batter's helmets, football helmets, and/or the like. Therefore, it is readily apparent that there is a recognized unmet need for an improved sweatband device that is suitable to effectively absorb, divert, and/or otherwise collect a user's perspiration, while also being suitable for a variety of activities (e.g., indoor aerobics, football, cycling, etc.) in a variety of conditions (e.g., temperature, humidity, precipitation, etc.).

BRIEF SUMMARY

Example implementations of the present disclosure are directed to an improved device for absorbing perspiration and/or preventing perspiration from entering a user's eyes. Additionally, some implementations of the present disclosure are directed to an improved device for manually removing perspiration from a sweatband device and/or diverting perspiration from the sweatband device to an area on the user's face so as to prevent the perspiration from entering the user's eyes, impeding vision, and/or increasing a user's comfort level when exertion causes the user to perspire.

According to one example aspect of the present disclosure, an interactive sweatband device is provided that may include a center portion having a first end and an opposing second end. The sweatband device may further include a first wing portion extending from and operably engaged with the first end of the center portion and a second wing portion extending from and operably engaged with the opposing second end of the center portion. The sweatband device may define a front surface and an opposing back surface. Additionally, the sweatband device may include an outflow channel that extends along and is defined by at least one of the front and opposing rear surface of the sweatband. Additionally or alternatively, the outflow channel may extend from the first wing portion to the second wing portion. In some aspects, the center portion, the first wing portion, and the second wing portion may include a hydrophilic material. Further, the center portion may include an indicia that is disposed on at least one of the front surface and the opposing rear surface. Additionally, the first wing portion and the second wing portion may be angled downward from a horizontal axis of the center portion.

According to some aspects of the present disclosure, the sweatband device may further include an adhesive material that is configured to adhesively secure the sweatband to a user's forehead. According to one example aspect, the adhesive material may be disposed proximate the back surface of the sweatband. In another example aspect, the adhesive material may be disposed proximate the front surface of the sweatband. Further, the adhesive material may be configured to adhesively secure the sweatband to an interior surface of a head protection device, wherein the adhesive material is disposed proximate the front surface and the rear surface of the sweatband.

In some aspects, the first wing portion may define a first end and an opposing second end, and the second wing portion may define a first end and an opposing second end. The outflow channel may extend from the first end of the first wing portion to the second end of the second wing portion. Additionally, the outflow channel may define a bottom outflow channel surface, a first side outflow channel surface, and a second side outflow channel surface. At least one of the bottom outflow channel surface, the first side outflow channel surface, and the second side outflow channel surface may include a hydrophobic material.

Example aspects of the present disclosure may further provide for a method for manufacturing a sweatband device. The method may include heating a hydrophilic material to a first temperature, applying an amount of pressure to the hydrophilic material, heating the hydrophilic material to a second temperature, shaping the hydrophilic material into a sweatband device that includes a center portion, a first wing portion, and a second wing portion, and providing an outflow channel to at least one of a front and rear surface of the sweatband device. Additionally, the method may further include providing an adhesive material to at least one of the front and rear surfaces of the sweatband device. In some aspects, the method may include providing a hydrophobic material to at least a portion of the sweatband device. Additionally or alternatively, the method may include applying an amount of pressure to deform the hydrophobic material from having an initial width to a subsequent width that is smaller than the initial width.

The features, functions and advantages discussed herein may be achieved independently in various example implementations or may be combined in yet other example implementations further details of which may be seen with reference to the following description and drawings.

BRIEF DESCRIPTION OF THE DRAWING(S)

Having thus described example implementations of the disclosure in general terms, reference will now be made to the accompanying drawings, which are not necessarily drawn to scale, and wherein:

DETAILED DESCRIPTION

Figure 1:
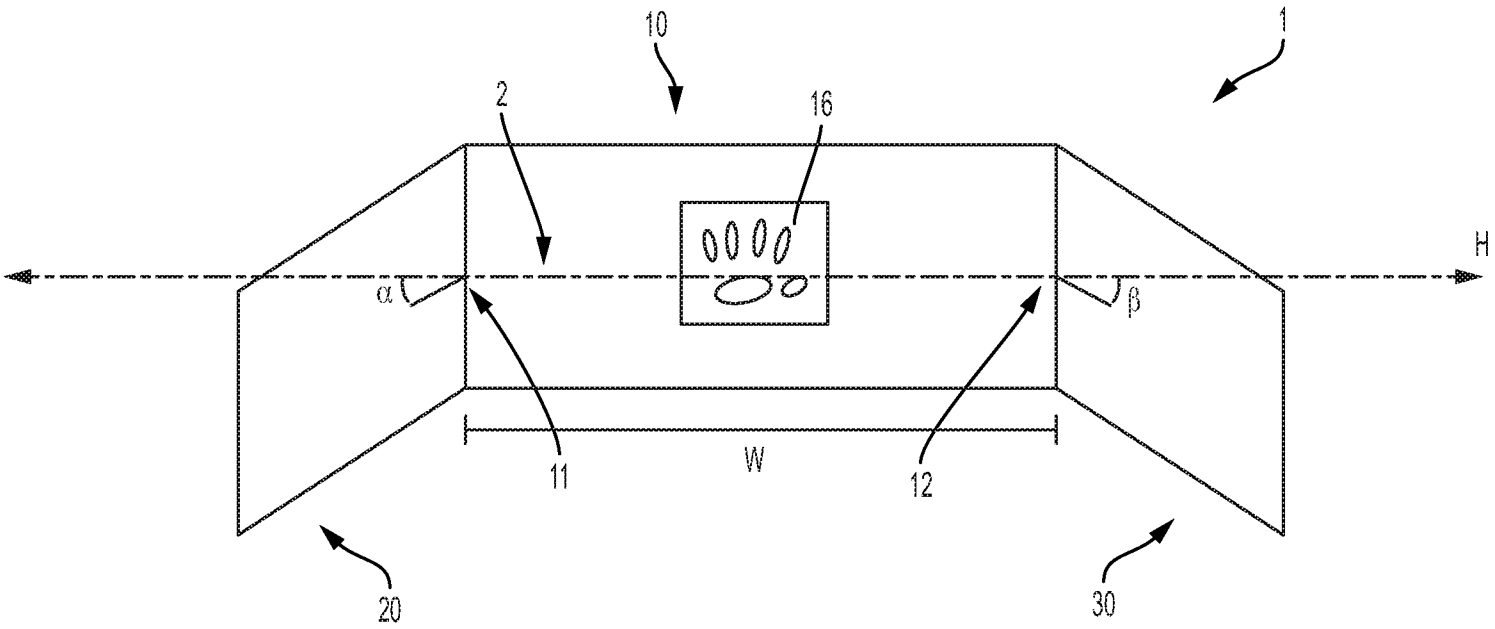
FIG. 1 illustrates a front view of a sweatband device according to one example implementation of the present disclosure.

Some implementations of the present disclosure will now be described more fully hereinafter with reference to the accompanying drawings, in which some, but not all implementations of the disclosure are shown. Indeed, various implementations of the disclosure may be expressed in many different forms and should not be construed as limited to the implementations set forth herein; rather, these exemplary implementations are provided so that this disclosure will be thorough and complete, and will fully convey the scope of the disclosure to those skilled in the art. As used herein, the term "and/or" and the "/" symbol includes any and all combinations of one or more of the associated listed items. Further, unless otherwise indicated, something being described as being a first, second or the like should not be construed to imply a particular order. It should be understood that the terms first, second, etc. may be used herein to describe various steps, calculations, positions and/or the like, these steps, calculations or positions should not be limited to these terms. These terms are only used to distinguish one operation, calculation, or position from another. For example, a first position may be termed a second position, and, similarly, a second step may be termed a first step, without departing from the scope of this disclosure. Additionally, something may be described as being above something else (unless otherwise indicated) may instead be below, and vice versa; and similarly, something described as being to the left of something else may instead be to the right, and vice versa. As used in the specification, and in the appended claims, the singular forms "a", "an", "the", include plural referents unless the context clearly dictates otherwise. Like reference numerals refer to like elements throughout.

Figure 2:
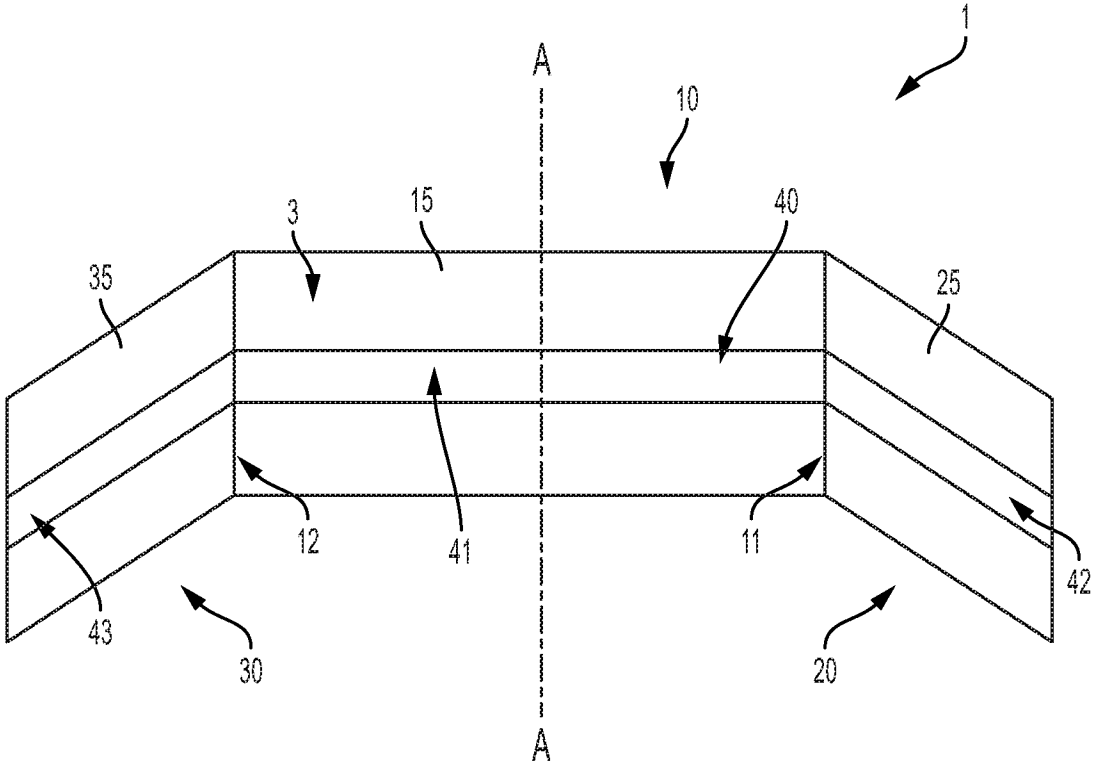
FIG. 2 illustrates a rear view of a sweatband device according to one example implementation of the present disclosure.
Figure 5:
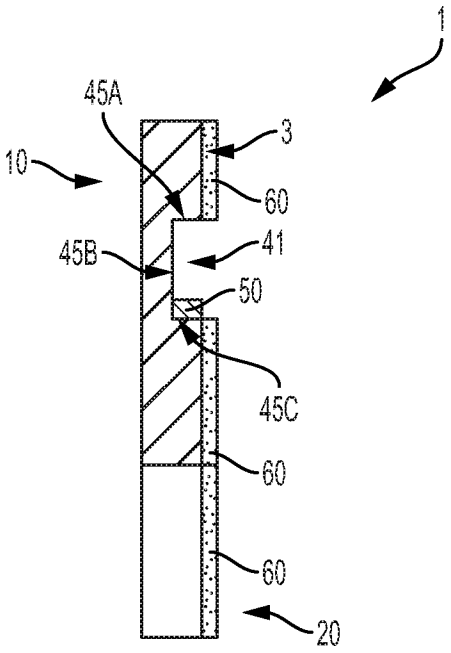
FIG. 5 illustrates a cross-sectional side view of the sweatband device of FIG. 2 according to one example implementation of the present disclosure.

Implementations of the present disclosure provide for an interactive sweatband device configured to prevent perspiration from flowing into a user's eyes. In some aspects, the interactive sweatband device may be further configured to absorb an amount of perspiration and redirect the flow of perspiration from the forehead of a user to another area on the user's face, such as the user's temples. According to some aspects, the sweatband device may be a disposable device so as to prevent the spread of an infection. In another aspect, the sweatband device may be a disposable device that may include recyclable materials. As shown in FIG. 1, a sweatband device 1 includes a center portion 10, a first wing portion 20, and a second wing portion 30. Additionally, the sweatband device 1 defines a front surface 2 and an opposing rear surface 3. For example, the center portion 10, the first wing portion 20, and the second wing portion 30 may define the front surface 2 and the opposing rear surface 3, as shown in FIGS. 1, 2, and 5.

Referring to FIG. 1, the center portion 10 may extend from a first end 11 to an opposing second end 12. In particular, the center portion 10 may extend substantially horizontally along a horizontal axis H from the first end 11 to the second end 12 and may define an overall width W. Although FIG. 1 illustrates the center portion 10 having a substantially rectangular shape, one of ordinary skill in the art may appreciate that the center portion may be shaped in any suitable manner such that the overall width W of the center portion is greater than a length defined by the spacing between the user's eyes. For example, a center portion may be shaped as a parabolic curve, wherein the overall width W defined by the horizontal distance between the first end and the opposing second end of the center portion is greater than the length defined by the spacing between the user's eyes.

Figure 4:
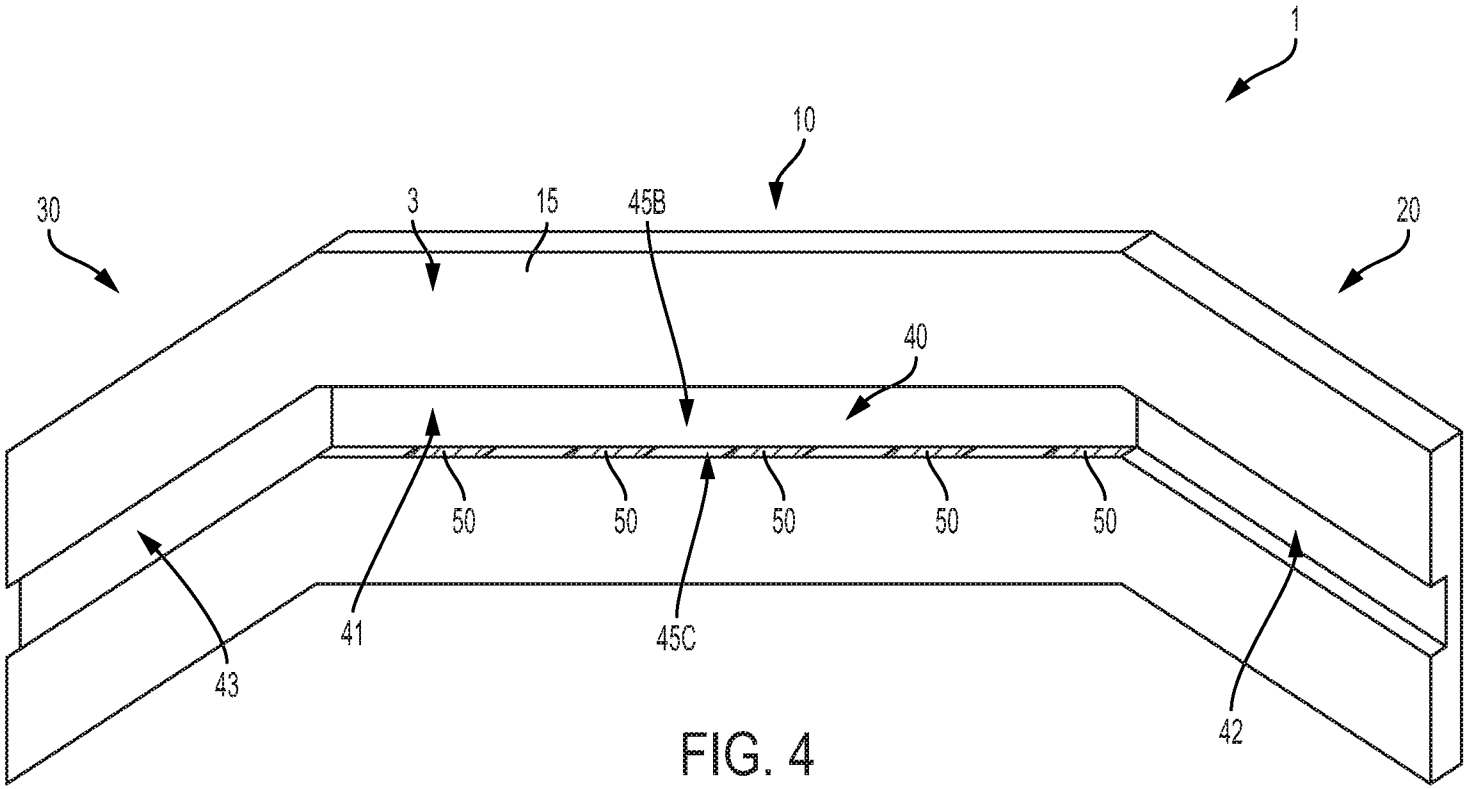
FIG. 4 illustrates a rear perspective view of a sweatband device according to another example implementation of the present disclosure.

As shown in FIGS. 1 and 4, the first wing portion 20 may extend from and be operably engaged with the first end 11 of the center portion 10. Additionally, the second wing portion 30 may extend from and be operably engaged with the second end 12 of the center portion 10. For example, the first wing portion 20 and the second wing portion 30 may be removably secured to the center portion 10 proximate the first end 11 and the opposing second end 12 of the center portion 10 respectively. In another aspect, the first wing portion 20 and the second wing portion 30 may be integrally formed with the center portion 10.

According to some aspects of the present disclosure, the first wing portion 20 and the second wing portion 30 may be angled from the center portion 10. For example, as shown in FIG. 1, the center portion 10 may extend along and define a horizontal axis H. The first wing portion 20 may be angled downwardly from the horizontal axis H so as to form a first angle $\alpha$ between the first wing portion 20 and the horizontal axis H of the center portion 10. Likewise, the second wing portion 30 may be angled downwardly from the horizontal axis H so as to form a second angle $\beta$ between the second wing portion 30 and the horizontal axis H of the center portion 10. In some aspects, the first angle $\alpha$ and the second angle $\beta$ may be substantially similar. Alternatively, the first angle $\alpha$ and the second angle $\beta$ may be different such that a first wing portion is angled downwardly from the center portion greater than a second wing portion angled from the center portion.

Referring to FIG. 2, the sweatband device 1 may include an outflow channel 40. For example, the rear surface 3 of the sweatband device 1 may define at least one outflow channel 40. Additionally or alternatively, the front surface 2 of the sweatband device 1 may define the outflow channel. In some aspects, the outflow channel 40 may be configured to remove perspiration absorbed by the sweatband device 1 to a desired location, such as, for example, to the temples of the user. Additionally or alternatively, the outflow channel 40 may be configured to remove perspiration absorbed by the sweatband device 1 thereby increasing the sweatband device's 1 rate of absorption. According to some aspects of the present disclosure, the rear surface 15 of the center portion 10 may define a center channel 41. The rear surface 25 of the first wing portion 20 may define a first wing channel 42, and the rear surface 35 of the second wing portion 30 may define a second wing channel 43.

According to one aspect, the center channel 41, the first wing channel 42, and the second wing channel 43 may, in part, form the outflow channel 40. Additionally, the center channel 41, the first wing channel 42, and the second wing channel 43 may be configured to fluidly communicate with one another. Aspects of the present disclosure may include a sweatband device 1 that is configured for a user to interact with to remove a desired amount of perspiration from the sweatband device to a desired location, such as, for example, a user's temples. This continued removal of perspiration from the sweatband device 1 extends the amount of time the sweatband device suitable absorbs the user's perspiration. In some aspects of the present disclosure, when perspiration absorbed by the sweatband device 1 accumulates, one may urge the perspiration to flow from the center portion 10 to the first and/or second wing portion 20, 30 via at least one of the center channel 41, first wing channel 42, and/or second wing channel 43. For example, applying pressure to the center portion 10 and moving the applied pressure from the center portion to either the first end 11 and/or second end 12 of the center portion 10 may cause perspiration to enter the center channel 41 and flow towards either of the first or second wing channels 42, 43 in accordance with the movement of the applied pressure. The accumulated perspiration thereby moves from the center portion 10 into the center channel 41 and then towards the first or second wing channels 42, 43 respectively. In some aspects, as shown in FIG. 1, the center portion 10 may further include an indicia 16 that provides for an indication as to where to apply pressure to the center portion 10 to remove accumulated perspiration from the sweatband device 1 with the outflow channel 40.

Figure 3:
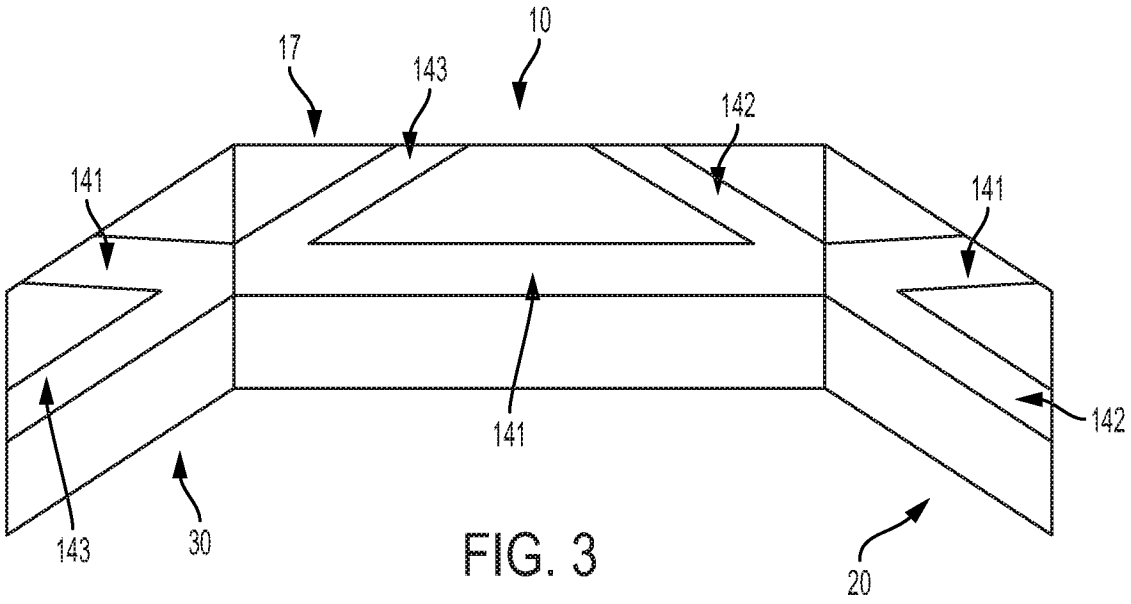
FIG. 3 illustrates a rear view of a sweatband device according to another example implementation of the present disclosure.

Referring to FIG. 3, the outflow channel 140 may include a center channel 141 that extends from the first wing portion 20 to the second wing portion 30. Additionally, the first wing channel 142 may extend from the first wing portion 20 to a top surface 17 of the center portion 10. Likewise, the second wing channel 143 may extend from the second wing portion 30 to the top surface 17 of the center portion 10. According to some aspects, the sweatband device 1 may include any suitably configured outflow channel to remove perspiration from the sweatband device to a first and/or opposing second end of the sweatband device.

According to another aspect of the present disclosure, the sweatband device 1 may include a hydrophilic and/or absorbent material suitable to absorb a fluid, such as, for example perspiration. The absorbent material may be any natural or synthetic material which will absorb perspiration. Woven and non-woven fabrics are suitable. Examples of suitable natural materials include cotton fabrics like terry cloth or flannel and pulp based fabrics. Suitable synthetic materials may include polyesters, polypropylenes, a combination of meltblown polymers and absorbent staple fibers such as cellulose, and/or the like. According to some aspects, the sweatband device may include polyvinyl acetate and/or other like materials. Combinations or blends of natural and/or synthetic materials may be used. The absorbent material may further include laminated absorbent articles to provide for absorbent material layer or layers.

According to one aspect of the present disclosure, the sweatband device 1 may further include a hydrophobic material 50, as shown in FIGS. 4 and 5, suitable to repel, deter, and/or force a fluid away from the hydrophobic material. In some aspects, the hydrophobic material 50, may include a hydrophobic substrate securely attached to at least one portion of the sweatband device 1. For example, the hydrophobic material 50 may be disposed proximate to at least a portion of the outflow channel 40. For example, according to one aspect, the hydrophobic material 50 may be disposed proximate a bottom surface 45 of at least one of the center channel 41, first wing channel 42, and second wing channel 43. As shown in FIG. 4, the hydrophobic material 50 may be disposed proximate the bottom surface 45 of the center channel 41 in spaced intervals so as to provide for a desired amount of perspiration to travel along the center channel 41 towards the first and/or second channels 42, 43 while simultaneously providing for perspiration to enter the center channel 41 from the center portion 10 via portions of the bottom surface 45 of the center channel 41 that do not include the hydrophobic material 50. According to some aspects of the present disclosure, the hydrophobic material may include a hypo-allergenic, non-toxic material that is configured to be non-irritating to a user's skin. Exemplary hydrophobic materials may include an aerosol spray, a substrate layer, and/or the like. For example, the hydrophobic material may include a fluorosurfactant aerosol that may be applied to at least a portion of the bottom surface 45 of at least one of the center channel 41, the first wing channel 42, and the second wing channel 43.

Additionally, the sweatband device 1 may include a suitable adhesive material 60, as shown in FIG. 5, that is configured to bind the absorbent material and to the user's skin. In some aspects, the adhesive material 60 may include an adhesive aerosol spray and/or an adhesive substrate. For example, one or more adhesive substrates, such as a dual-sided surgical tape, may be disposed proximate at least one of the front and rear surface 2, 3 of the sweatband device 1. In some aspects, the front surface 2 may include the adhesive material 60 so as to adhere the sweatband 1 to an interior of a helmet, such as, for example, a football helmet, a bicycle helmet, and/or the like. According to another example aspect of the present disclosure, an adhesive material, such as an adhesive aerosol spray, may be applied to at least one of the front and rear surfaces of the sweatband device, and an adhesive substrate may be disposed proximate to the adhesive aerosol spray so as to adhere the sweatband device to the user's skin.

Preferably, the adhesive material is a pressure sensitive adhesive that is hypo-allergenic, non-toxic, non-irritating to skin, adherent to skin when exposed to perspiration, readily removable from skin, and has a sufficient internal strength so that it will leave minimal adhesive residue on the skin when the sweatband device is removed. The adhesive material may or may not be permeable to fluids, such as for example, a user's perspiration, water, and/or the like. Examples of suitable adhesive materials include acrylate, polyolefin-based, polyurethane, natural or synthetic rubber polymer, silicone, and styrene-isoprene-styrene block pressure sensitive adhesives. In some aspects, the adhesive material may be configured to be impermeable to fluids and/or hydrophobic so as to urge fluids away from the adhesive material.

Figure 6:
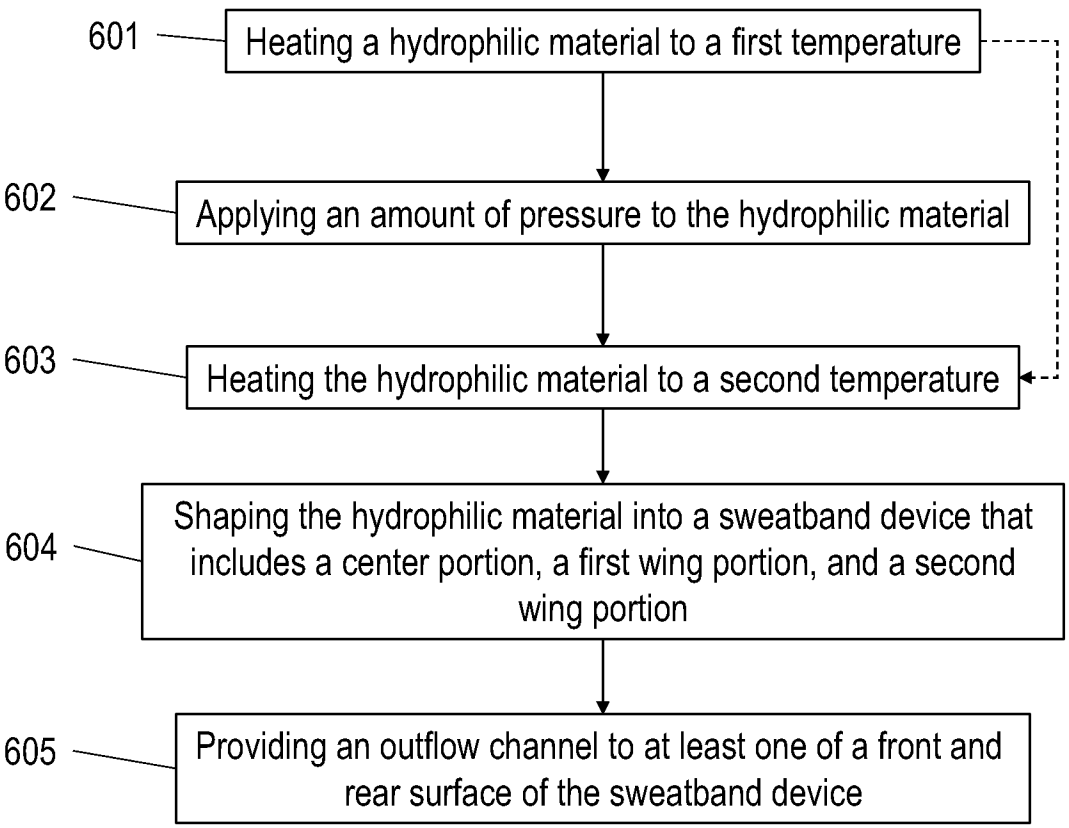
FIG. 6 illustrates a block diagram of a method for manufacturing a sweatband device according to one example implementation of the present disclosure.

Referring to FIG. 6, a method for manufacturing a sweatband device 600 may include heating a hydrophilic material to a first temperature 601. In some aspects, the hydrophilic material may be heated to a first temperature of approximately between 70 and 90 degrees Fahrenheit. In another aspect, the hydrophilic material may be heated to a first temperature of approximately between 60 and 100 degrees Fahrenheit. In yet another aspect, the hydrophilic material may be heated to a first temperature of approximately between 50 and 110 degrees Fahrenheit. According to some aspects, heating the hydrophilic material to a first temperature may cause the width of the hydrophilic material to decrease from a first width to a second width. For example, the first width of the hydrophilic material may be approximately 6.0 mm, and the second width of the hydrophilic material may be approximately 3.0 mm.

The method may further include applying an amount of pressure to the hydrophilic material 602. For example, the method may include applying an amount of pressure to decrease the width of the hydrophilic material from a second width to a third width. In some aspects, applying pressure to the hydrophilic material may decrease the width of the hydrophilic material by approximately between 45-55%. According to another aspect, applying pressure to the hydrophilic material may decrease the width of the hydrophilic material by approximately between 40-60%. For example, applying pressure to hydrophilic material may cause the hydrophilic material having a second width of approximately 3.0 mm to decrease in width to a third width of approximately 1.5 mm.

Additionally or alternatively, the method may include heating the hydrophilic material to a second temperature 603. In some aspects, the hydrophilic material may be heated to the second temperature concurrently with the pressure being applied to the hydrophilic material in step 602. In some aspects, the pressure being applied to the hydrophilic material and the heating of the hydrophilic material to the second temperature may deform the hydrophilic material from a second width to a desired third width, as described herein.

As shown in FIG. 6, the method may further include shaping the hydrophilic material into a sweatband device 604 that may include a center portion, a first wing portion, and/or a second wing portion, as described herein. The hydrophilic material may be shaped using suitable manufacturing techniques such as die cutting, extrusion, and/or the like. The hydrophilic material may be shaped such that the first and second wing portions angle downwardly from a horizontal axis of the center portion. Additionally or alternatively, the hydrophilic material may be shaped such that the center portion defines a width that is at least greater than the space between a user's eyes.

In some aspects, the method may further include providing an outflow channel to at least one of a front and rear surface of the sweatband device 605. For example, the outflow channel may be provided to the rear surface of the sweatband device. In one aspect of the present disclosure, the outflow channel may be formed by engaging a channel preform with the sweatband device and/or hydrophilic material so as to form the reciprocally shaped outflow channel. As is depicted in FIGS. 2-6, in accordance with some embodiments of the invention, the outflow channel may in the form of a groove cutout, the groove cutout having been formed by the channel preform or some other method. For example, the channel preform may be shaped substantially similar to a layout of the outflow channel such that when the channel preform is engaged with the sweatband device and/or hydrophilic material, the outflow channel is formed on at least one of the front and/or rear surface of the sweatband device. In some aspects, the channel preform may be heated to a desired temperature prior to engaging the channel preform with the sweatband device and/or hydrophilic material. Further, the channel preform may be heated to a desired temperature, which may be substantially similar to the second temperature. Additionally or alternatively, the channel preform may be heated to a desired temperature and may be concurrently engaged with the sweatband device and/or hydrophilic material by applying an amount of pressure to the channel preform against the sweatband device and/or hydrophilic material.

The method may further include providing an adhesive material to at least one of the front and/or rear surface of the sweatband device. For example, an adhesive aerosol and/or an adhesive substrate may be applied to at least a portion of the sweatband device such that sweatband device may adhere to the user's skin. Additionally, the method may further include providing a hydrophobic material to at least a portion of the sweatband device. For example, the method may include providing a hydrophobic material to at least a portion of the outflow channel of the sweatband device. In some aspects, the method may include providing the hydrophobic material to at least a portion of the outflow channel of the sweatband device such that the hydrophobic material is disposed proximate at least one surface of the outflow channel in spaced intervals.

Many modifications and other implementations of the disclosure set forth herein will come to mind to one skilled in the art to which the disclosure pertains having the benefit of the teachings presented in the foregoing description and the associated drawings. Therefore, it is to be understood that the disclosure is not to be limited to the specific implementations disclosed and that modifications and other implementations are intended to be included within the scope of the appended claims. Moreover, although the foregoing description and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A sweatband device comprising: an integrally-formed center portion having a first end opposite a second end and essentially comprising a flat front surface opposite a flat back surface, wherein; the flat front surface defines a groove cut-out extending in a straight line between the first end and the second end; the center portion having an upper edge and a lower edge, wherein the straight line is parallel to the upper edge and the lower edge;

a first wing portion extending downward and away from the center portion from the first end; and a second wing portion mirroring the first wing portion and extending downward and away from the second end.

2. The sweatband device of claim 1, wherein the center portion, the first wing portion, and the second wing portion include a hydrophilic material.

3. The sweatband device of claim 1, wherein the center portion further comprises an indicia disposed on at least one of the front surface and/or the opposing rear surface.

4. The sweatband device of claim 1, wherein the first wing portion and the second wing portion are rhomboidal and the center portion is rectangular.

5. The sweatband device of claim 1 further comprising an adhesive material, the adhesive material configured to adhesively secure the sweatband to a user's forehead.

6. The sweatband device of claim 1, wherein the groove cut-out further extends from the first end into the first wing portion and from the second end into the second wing portion.

7. The sweatband device of claim 6, wherein the groove cut-out extends downwardly through an entire first wing length of the first wing portion and through an entire second wing length of the second wing portion.

8. The sweatband device of claim 6:

wherein the first wing portion defines a first wing groove cut-out extending along an entire first wing length of the first wing portion and into the center portion, intersecting with the groove cut-out; and wherein the second wing portion defines a second wing groove cut-out extending along an entire second wing length of the second wing portion and into the center portion, intersecting with the groove cut-out.

* * * * *